United States Patent [19]

Guenard

[11] 4,149,107

[45] Apr. 10, 1979

[54] BACKWARD WAVE OSCILLATOR TUBE FOR THE PRODUCTION OF MICROWAVE

[75] Inventor: Pierre Guénard, Paris, France

[73] Assignee: Thomson-CSF, Paris, France

[21] Appl. No.: 790,318

[22] Filed: Apr. 25, 1977

[30] Foreign Application Priority Data

Apr. 29, 1976 [FR] France ..... 76 12826

[51] Int. Cl.[2] ..... H01J 25/34

[52] U.S. Cl. ..... 315/3.6; 315/3.5; 315/393

[58] Field of Search ..... 315/3.6, 3.5, 39.3

[56] References Cited

U.S. PATENT DOCUMENTS 2,916,658 12/1959 Currie ..... 315/3.6

2,955,226 10/1960 Currie et al. ..... 315/3.6

*Primary Examiner*—Saxfield Chatmon, Jr.

*Attorney, Agent, or Firm*—Roland Plottel

[57] ABSTRACT

The present invention relates to a backward wave mode travelling wave oscillator tube.

The delay line is in two sections of dissimilar length, 40 and 42, aligned in the direction of propagation of the electron beam (the cross-hatched area); the second 42 being the shorter, receives the beam already modulated by the first, 40, operating in the backward wave mode. The load 8 is arranged at that end which is adjacent the electron-gun 1, 2, of the second delay line section, also operating in the backward wave mode.

Application to the design of high-output backward wave tubes for operation in the millimetric sub-millimetric wavebands.

3 Claims, 3 Drawing Figures

BACKWARD WAVE OSCILLATOR TUBE FOR THE PRODUCTION OF MICROWAVE

The present invention relates to a backward wave electronic oscillator tube for generating radio waves in the microwave range. The tube which forms the object of the present invention relates more particularly to the generation of waves in the millimetric and submillimetric wavebands.

In the following, some of the features of travelling wave tubes in general will be recapitulated. In these tubes, there is an interaction between an electron beam and a delay line of periodic structure arranged opposite the beam, along which delay line electromagnetic energy propagates. The interaction in question occurs between those components of the electromagnetic field which appear in the neighbourhood of the delay line, and the electron beam itself, when the phase velocity of these components is close to that of the electrons in the beam, and moreover in the same direction thereas.

In travelling wave tubes of forward wave or in other words progressive wave kind, propagation of the energy along the delay line also takes place in the same direction as the velocity of the electrons in the beam; in those of backward wave design, regressive wave tubes, by contrast it takes place in the opposite direction. However, amongst the aforementioned components there exists at least one whose phase velocity is negative, that is to say is directed in the opposite direction to the direction of propagation of the energy and thus the direction of propagation of the beam. Whereas in these latter tubes the energy propagates towards that end of the delay line where the beam enters the interaction space, one of these components has its phase velocity directed in the direction of the beam. If a component of this kind is the predominant component in the interaction in question, the tube is referred to as a backward wave tube and the power is picked off at that end of the tube which is opposite to the end at which the beam leaves the interaction space, that is to say at the end adjacent the cathode at which the beam emanates. Both these kinds of tubes are well known from the prior art, the latter type in particular from U.S. Pat. Nos. 2,932,760; 2,888,597; 2,880,355, reference to which will be made as necessary.

Travelling wave tubes of backward wave design, that is to say regressive wave tubes, offer the advantage of having a very wide electronic tuning band, continuously variable by parameters upon which the electron velocity depends, that is to say the voltage on the delay line, if there is only an electric field applied to the electrons, or the electric field and the magnetic flield if, as in so-called crossed-field tubes, these two kinds of fields are both applied to the beam.

However, the designs produced by the present applicant has shown that the inherent attenuation of the delay lines used in the millimeter and sub-millimeter wavebands is often extremely high and may reach around 100 decibels overall. In particular in backward wave tubes, this is translated into terms of an output power, picked off across the external load coupled to the delay line at a point located close to the cathode system of the tube, which, under the best conditions of adjustment, is very much lower than that expected in accordance with the theoretical predictions made upon the hypothesis of a loss-free line; we shall return to this point later on in the description.

To overcome this drawback, it has been necessary to increase the length of the line in order to increase the interaction length between beam and line; at the same time, however, the total losses in the delay line are increased as a consequence so that ultimately no appreciable improvement is reached.

After analysing this difficulty, the applicant has arrived at a travelling wave tube structure in accordance with the invention, operating in the backward wave mode, in which this power loss is substantially limited. The structure in accordance with the present invention makes it possible, other things being equal, to achieve a substantial increase in the output level from travelling wave tubes of backward wave design in relation to the prior art tubes of the same kind. This constitutes an advantage of the present invention over the prior art.

The invention will be better understood from a consideration of the ensuing description and the attached figures where similar references designate similar elements and in which.

Figure 1:
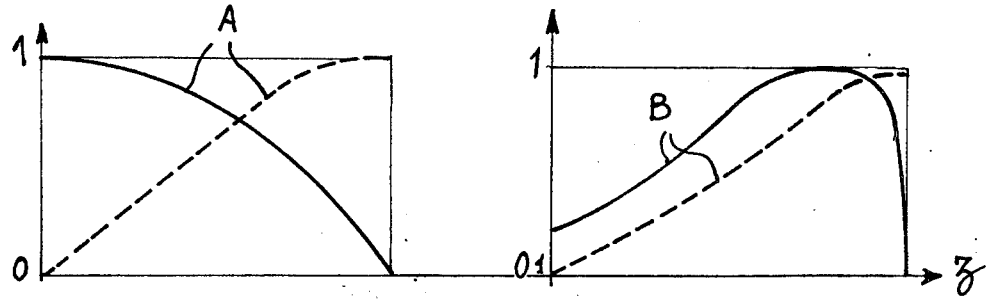
FIG. 1 is a diagram intended to show the inherent limits of the prior art systems.

FIG. 1 illustrates how the distribution of the power along the delay line of a backward wave travelling wave tube is modified by the losses along the line. The abscisse z, the origin of which coincides with that end of the delay line located adjacent the cathode, is aligned in the direction of propagation of the beam. The ordinates plot the ratios between the alternating electric field E on the delay line at each point of the line, and the peak electric field $E_m$ (full-line curves) and the ratios of alternating current I in the beam at peak current $I_m$ (broken-line curves), for the case of a loss-free line (curve A) and a loss-loaded line (curves B).

Whereas in a loss-free delay line the electric field and the wave power peak occur at the origin of the abscissae, i.e. at that end of the delay line adjacent the cathode of the tube, this coinciding substantially with the location of the load from which said power is picked off (curve A), it will be seen from curve B that in the case where the line involves losses, the peak occurs at a point away from the origin; the further this point is away from the origin the higher the losses in the line. Under these conditions the power picked off from the load is much lower than the peak power indicated by the theoretical curve A, as is demonstrated by the value of the abscissae point zero on the full-line curve B.

To prevent this shift from taking place, with the attendant drawback referred to earlier, in terms of the peak output power, the invention designs the backward wave tube delay line in the form of two parts aligned in the direction of the electron beam, in the manner described hereinafter.

Figure 2:
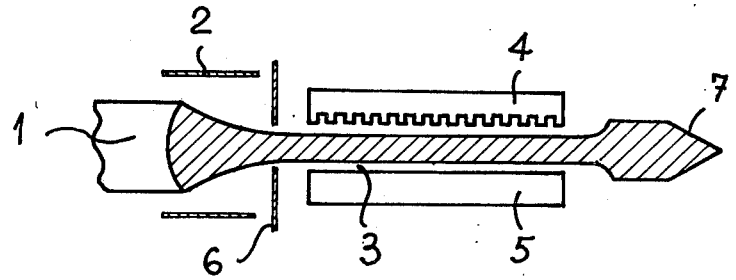
FIG. 2 is a schematic view of a travelling wave tube.

First of all, a remainder of the general structure of a travelling wave tube; this structure is represented in FIG. 2 which is a schematic sectional view.

In this figure, the reference 1 designates the cathode of the tube from which, in operation, the electron beam (cross-hatched area) issues, the beam undergoing an initial convergence brought about by a focussing electrode 2, or modulating electrode, surrounding the cathode. The beam is accelerated towards the entrance of the tunnel 3 defined between the delay line of the tube, indicated by the toothed rectangle 4, and a plate electrode 5 disposed opposite it, by a direct potential difference $V_o$ applied between these two latter elements, which function as an anode, and the cathode 1 or zero reference potential. In the example shown in the Figure, an electrode 6 located in the neighbourhood of the cathode and placed in relation to the latter at a potential which is a small fraction of $V_o$, in fact about 100th of the latter, is used to control the beam current. The electron beam is collected beyond the tunnel 3 by the collector or catcher 7, brought to the suitable potential with regard to the cathode 1, by means of a source not shown. In a general way, neither sources nor their connexions to the electrodes energized therefrom, according to known art, have been shown in the drawing. The part located between the electrodes 4 and 5 is the microwave section of the tube; the representation of the delay line as a toothed rectangle 4, corresponds to the case of a fin type delay line; this kind of design will be known to those skilled in the microwave art. Arrangements which have not been shown but which are well known per se. are provided, finally, to prevent the natural divergence of the beam which would occur under the effect of the space charge, and to bunch it through the tunnel 3 over the whole of the requisite length.

In the diagram of FIG. 2, no load for the picking off of the energy at the output of the tube has been shown, nor has any input. This is because the object of this figure is to provide a general reminder of the structure of travelling wave tubes whatever their mode of operation, forward wave or backward wave, and their nature, oscillator, amplifier etcetera.

Figure 3:
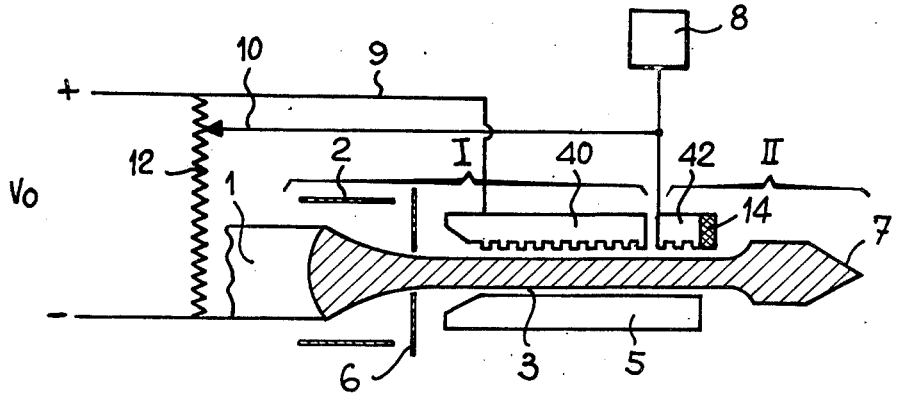
FIG. 3 is a schematic view of an embodiment of the backward wave tube in accordance with the invention.

These points will be dealt with in more detail in the context of the variant embodiment of the invention which is now to be described by way of non-limitative example, in relation to FIG. 3.

In FIG. 3 there are to be found, along with their references, the elements of FIG. 2 already referred to. However, whereas in the latter the delay line 4 was made up of a single delay line, the structure of FIG. 3 comprises two delay line sections which are separate from one another, marked 40 and 42 and aligned in the direction of propagation of the beam. In the tube of FIG. 3, the two parts of the line 40 and 42 operate in the backward wave mode. The tube comprises two sections I and II united in the same evacuated envelope which, in the schematic illustrations of FIGS. 2 and 3, has not been shown.

The first section I of the tube has no output; the characteristics of the delay line section 40 are arranged, in other words, in such a way that the output power at the end of the line section 40 located close to the cathode system 1, 2 is virtually zero. This corresponds to the situation in which the graph of the field along the section 40 of the delay line in section I of the tube, has the form of the graph B shown in full line in FIG. 1 and joins the ordinate access close to the origin $0_1$. Virtually no power is thus developed in the section I of the tube, the effect of which latter is virtually zero as far as the power-generating function is concerned; the only effect of this section is to modulate the electron beam before it enters the section II. The section I performs the function of a beam modulator so that at exit therefrom the beam already contains an alternating component when it is about to enter the second part of the delay line 42 in tube section II. This latter section operates as a backward wave oscillator. The presence of the aforesaid component makes it possible to reduce the length of this section whilst still having a final modulation depth sufficient to ensure that the tube generates a power level which is less effected by the inherent losses in the line than it is in the single delay line tubes of the prior art. This power is picked off in the load 8 connected at the left-hand end of the section 42 of the delay line. In a variant embodiment of the invention, this section is placed at the same potential as the section 40 in relation to the cathode of the tube. Then, in this case, it has the same electrical characteristics, that is to say a delay factor and a pitch substantially identical to those of the section 40. Its length is shorter than that of the latter and substantially equal to the distance between the point of zero power and the point of peak power on its graph corresponding to the curve B (FIG. 1). This length is less than the one needed for generating a high frequency signal with a beam unmodulated before entering this section.

For various reasons it is generally necessary to provide a slight difference in potential between the two delay line sections 40 and 42, of the order of one hundredth of the voltage $V_o$, to achieve optimum operation. This variant embodiment also falls within the scope of the invention. In FIG. 3 the potentiometer circuit has been shown which makes it possible to create these two variants: the references 9 and 10 designate in the drawing the connections of the sections 40 and 42 of the delay line, whilst the reference 12 indicates the potentiometer connected between the terminals of the source, the latter not having been shown. The reference 14 represents an absorber designed in some prior art fashion or other, terminating the delay line section 42 and designed to prevent any reflection of the waves at the end of this section.

What has been said in the foregoing applies equally to tubes in which the electron beam is subjected to the dual action of an electric field and a magnetic field intercepting one another at right-angles, of the kind well-known in the prior art of travelling wave tubes, and in particular from the aforementioned patent.

Finally, the invention covers all the other variant embodiments open to the person skilled in the art and deriving from that described hereinbefore by way of example.

The invention relates to the design of high frequency, wideband backward wave generators, whose frequency is variable by the velocity of propagation of the beam along the delay line, in particular generators for operation in the millimetric and sub-millimetric wavebands. It is possible to achieve a substantial increase in the output level. For example, at 1000 GHz and using two delay line sections 40 and 42 respectively 16 mm and 3 mm long, the output power picked off in the load 8 (FIG. 3) is of the order of 10 milliwatts whereas it would only be around 0.1 milliwatt in a load coupled to the left-hand end of a tube of the same length comprising a single delay line.

Of course, the invention is not limited to the embodiment described and shown which was given solely by way of example.

I claim:

1. A backward wave oscillator which comprises:

a source of a beam of electrons;

means for focusing said beam of electrons;

a collector spaced from said source for receiving said beam of electrons; and a delay line exhibiting an attenuation factor per unit length, disposed intermediate said collector and said electron beam source along which delay line an electromagnetic wave propagates in operation and interacts with the beam characterized in that: said delay line comprises a first and a second delay line section, said first delay line section modulating the electron beam as it passes thereunder and having a length such that due to its attenuation factor per unit length substantially no energy is available at the end thereof closest to said electron beam source as a result of said interaction, the only result of said interaction being a modulation of the electron beam;

said second delay line section is substantially shorter than said first delay line section is incapable of sustaining oscillations in the absence of the priorly modulated electron beam, the length of said second delay line section being such that due to its attenuation factor per unit length sustain oscillations under interaction with the electron beam priorly modulated by the first delay line section are generated, said backward wave oscillator further comprising:

means, coupled to said second delay line section, for extracting oscillatory energy from the backward wave oscillator.

2. The oscillator according to claim 1 wherein the electro-magnetic energy propagating along said first delay line section propagates in the reverse direction to the beam and has a component which intersects with the beam, said component having a phase velocity close to that of the beam and being directed in the same direction of propagation, said second delay line section has the same propagation characteristics as the first delay line section, and is shorter than the latter, the velocity of the electron beam being uniform over the entire length of its trajectory from source to collector, and said energy extracting means is coupled to the end of said second delay line section which is closest to said beam source.

3. The oscillator according to claim 1 wherein the electro-magnetic energy propagating along said first delay line section propagates in the reverse direction to the beam and has a component which intersects with the beam, said component having a phase velocity close to that of the beam and being directed in the same direction of propagation, said second delay line section has the same propagation characteristics as the first delay line section, and is shorter than the latter, the velocity of the electron beam being slightly lower along the second delay line section, and said energy extracting means is coupled to the end of said second delay line section which is closest to said beam source.

* * * * *